US008973201B1

(12) United States Patent
De Vito et al.

(10) Patent No.: US 8,973,201 B1
(45) Date of Patent: Mar. 10, 2015

(54) BROOM ASSEMBLY

(71) Applicants: Joseph M. De Vito, Harpursville, NY (US); David Hitchcock, Walton, NY (US)

(72) Inventors: Joseph M. De Vito, Harpursville, NY (US); David Hitchcock, Walton, NY (US)

( * ) Notice: Subject to any disclaimer, the term of this patent is extended or adjusted under 35 U.S.C. 154(b) by 0 days.

(21) Appl. No.: 14/071,909

(22) Filed: Nov. 5, 2013

(51) Int. Cl.

| | |
|---|---|
| ***A46B 5/00*** | (2006.01) |
| ***A46B 15/00*** | (2006.01) |
| ***A46B 7/02*** | (2006.01) |
| ***B60S 3/04*** | (2006.01) |
| ***A46B 7/04*** | (2006.01) |
| ***A46B 17/02*** | (2006.01) |

(52) U.S. Cl.
CPC .. *A46B 7/04* (2013.01); *A46B 17/02* (2013.01)
USPC ..... 15/160; 15/144.1; 15/144.4; 15/145; 15/172; D4/130; D32/51

(58) Field of Classification Search
USPC ..... 15/144.1–144.4, 145, 146, 159.1, 160, 15/172; D4/130, 132, 138; D32/50, 51
See application file for complete search history.

(56) References Cited

U.S. PATENT DOCUMENTS

| | | | | |
|---|---|---|---|---|
| 1,438,741 | A * | 12/1922 | Benoit | 15/144.1 |
| 3,928,886 | A * | 12/1975 | Marino et al. | 15/144.2 |
| 3,994,037 | A * | 11/1976 | Sims | 15/146 |
| 5,809,604 | A * | 9/1998 | Olstyn | 15/111 |
| 6,709,529 | B1 * | 3/2004 | Mekwinski | 134/6 |
| 2004/0250367 | A1 * | 12/2004 | Fraser | 15/245 |
| 2006/0117510 | A1 * | 6/2006 | Sellers | 15/160 |

* cited by examiner

*Primary Examiner* — Mark Spisich
(74) *Attorney, Agent, or Firm* — Maier & Maier, PLLC

(57) ABSTRACT

A broom assembly is provided. The broom assembly includes a broom head which comprises an elongated back plate and a plurality of bristles extending from the back plate. The broom assembly also includes an elongated mounting plate which is attached to the back plate and extends over a longitudinal end of the back plate. A handle receiving bracket is attached to the mounting plate, projecting the same direction from the mounting plate as the broom head. The handle receiving bracket comprises at least two receiving cavities for attaching a handle. The broom assembly further comprises an elongated handle for insertion in the handle receiving bracket.

14 Claims, 5 Drawing Sheets

BROOM ASSEMBLY

BACKGROUND

This application relates generally to sweeping devices, and more particularly, to brooms and brushes that utilize a handle and an inverted brush head.

In at least some known Recreational Vehicles (RV's), a top of a hard to reach area must be swept as a part of normal maintenance and cleaning. Specifically, an RV may have a slideout section for expanding the interior of the RV, and these slideouts may need to be free of debris and liquid, such as rain water, before they are moved to a retracted position in order to prevent harm to the RV. Debris can damage the seal around the slideout, leading to leaks and other unwanted consequences. Some slideouts also have retractable awnings protecting the top of the slideout itself, but these awnings should similarly be free of debris and liquid before they are retracted. RV owners and users are forced to climb on top of the RV or hang off of a ladder to reach these areas. It can not only be difficult climbing up to free the areas of debris, but it can be very dangerous at such heights. It is especially dangerous if the surface is wet, which is commonly the case.

Similarly, the tops of objects in other areas of life may be difficult or dangerous to reach, but still require cleaning. Household examples include but are not limited to the sweeping of awnings or bay windows.

SUMMARY

In one exemplary embodiment, a broom assembly is provided. The broom assembly may include a broom head which includes an elongated back plate and a plurality of bristles extending from the back plate. The broom assembly may further include an elongated mounting plate which is attached to the back plate and extends over a longitudinal end of the back plate. A handle receiving bracket may be attached to the mounting plate, disposed on the same face of the mounting plate as the broom head. The handle receiving bracket may have at least two handle receiving cavities. An elongated handle may also be included in the broom assembly and may be securable in a receiving cavity of the handle receiving bracket.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION

Figure 1:
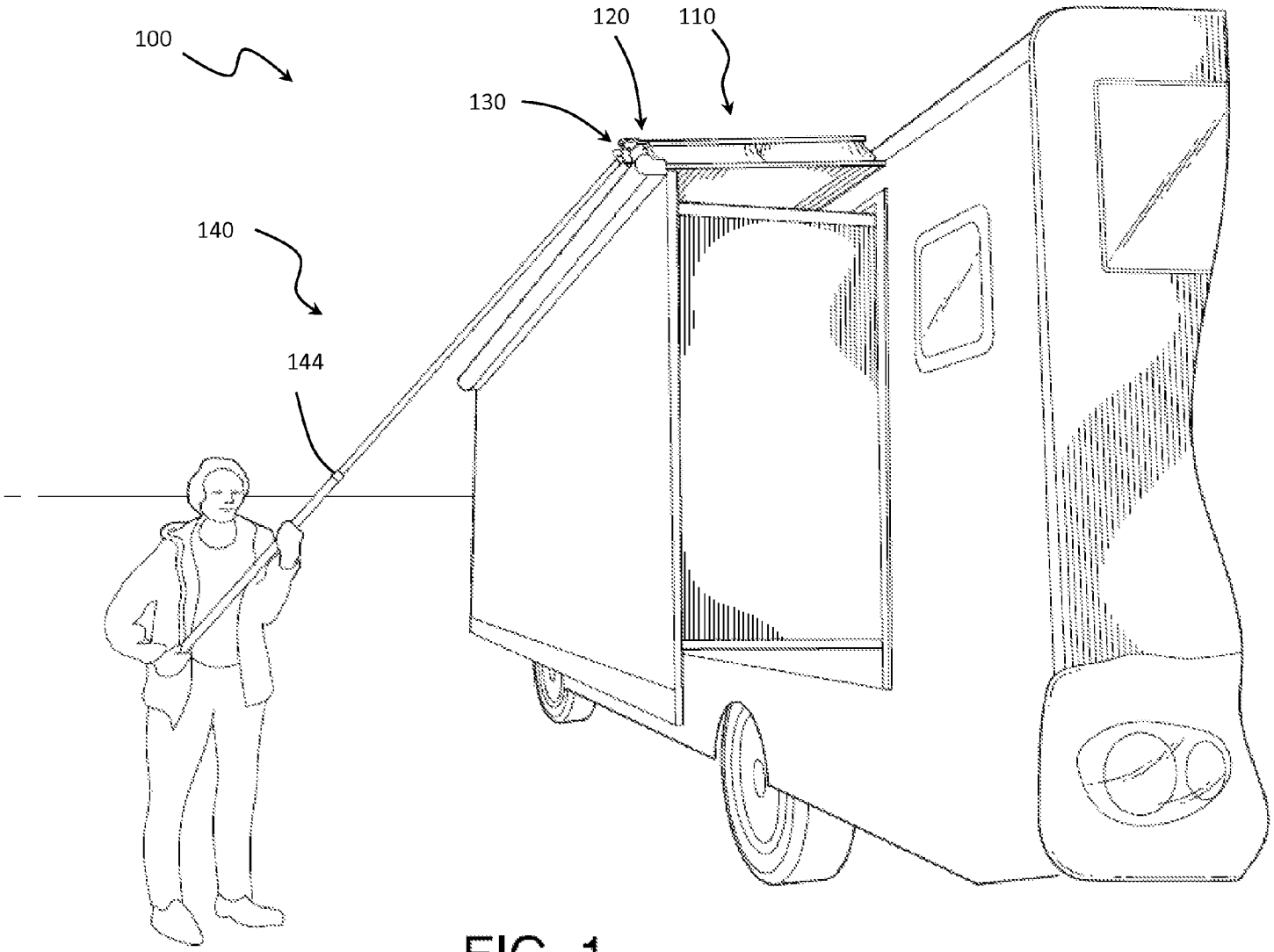
FIG. 1 is a perspective view of a broom assembly that may be used to clean the top of an RV.
Figure 2:
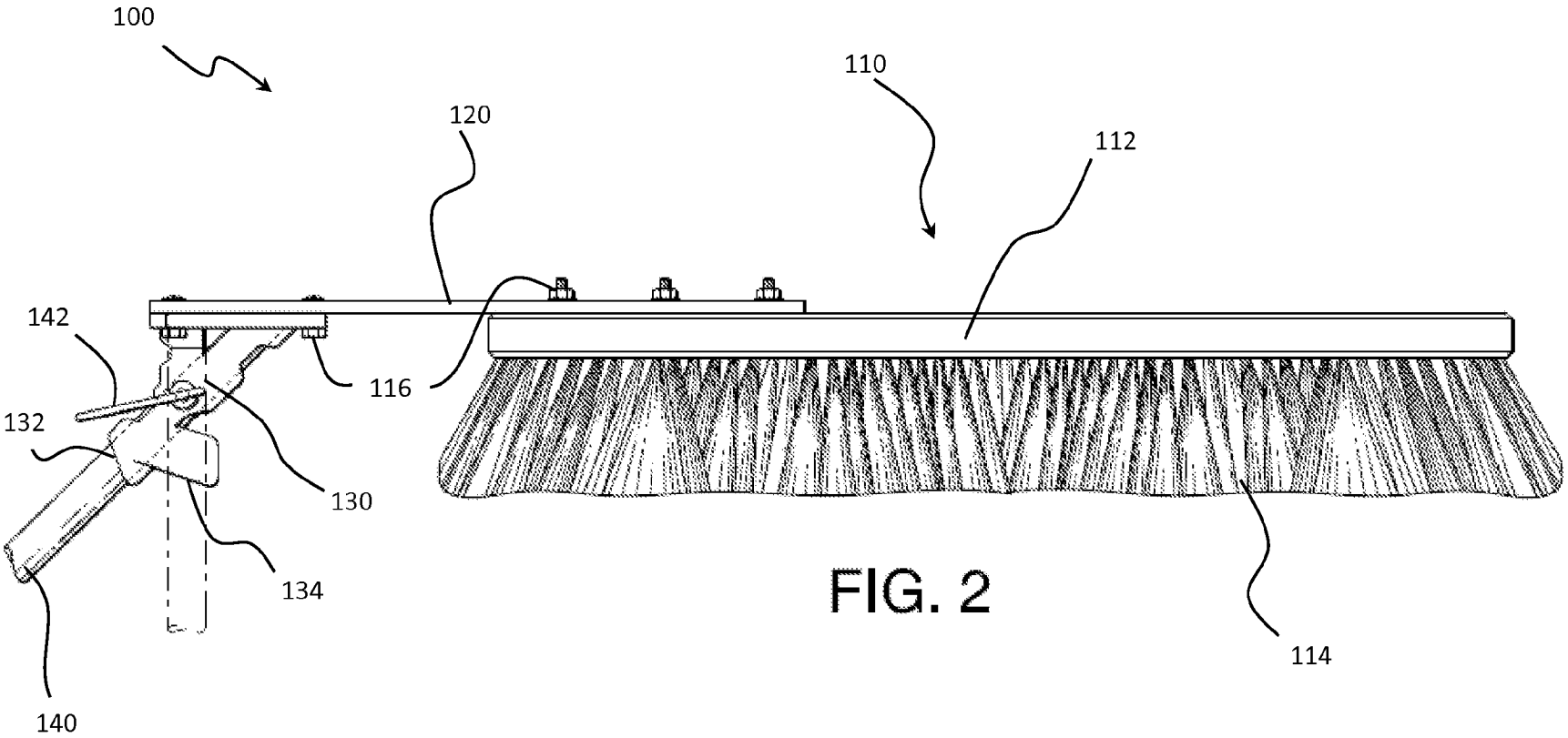
FIG. 2 is a side elevation view of a broom assembly.
Figure 3:
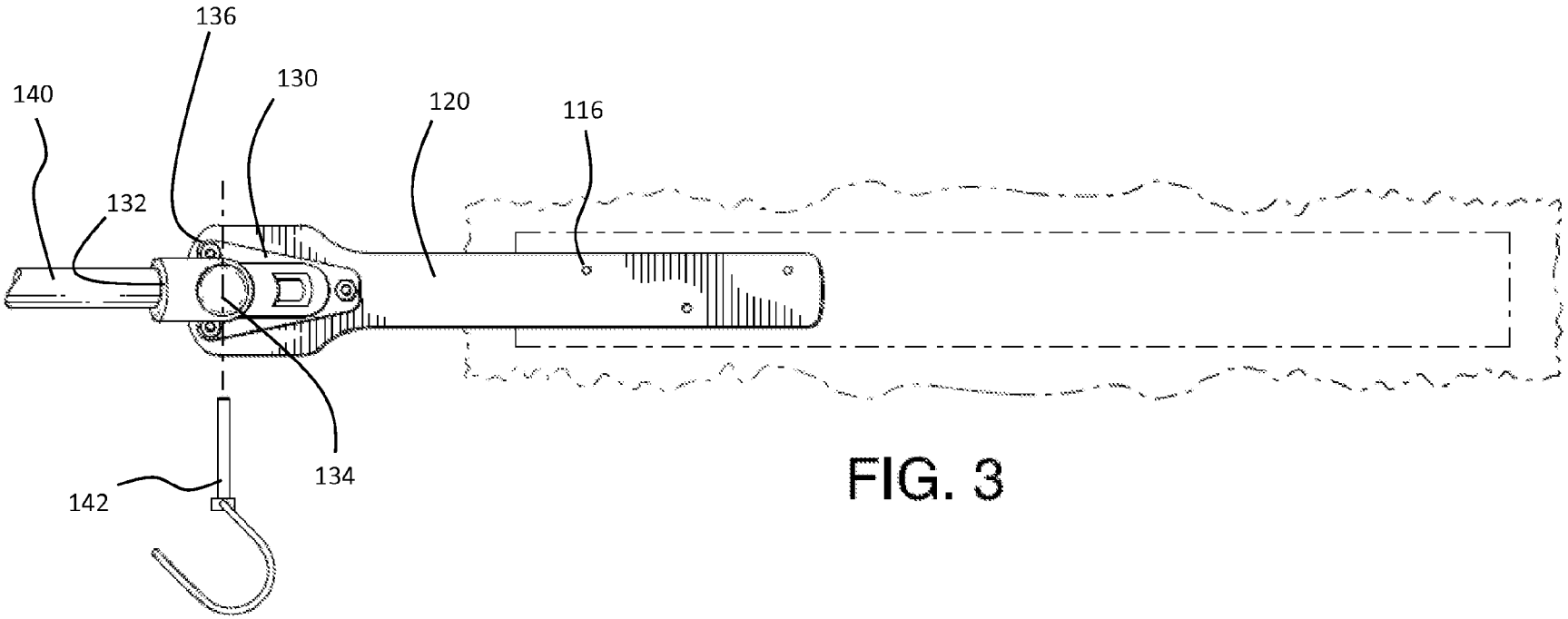
FIG. 3 is a bottom plan view of a broom assembly.
Figure 4:
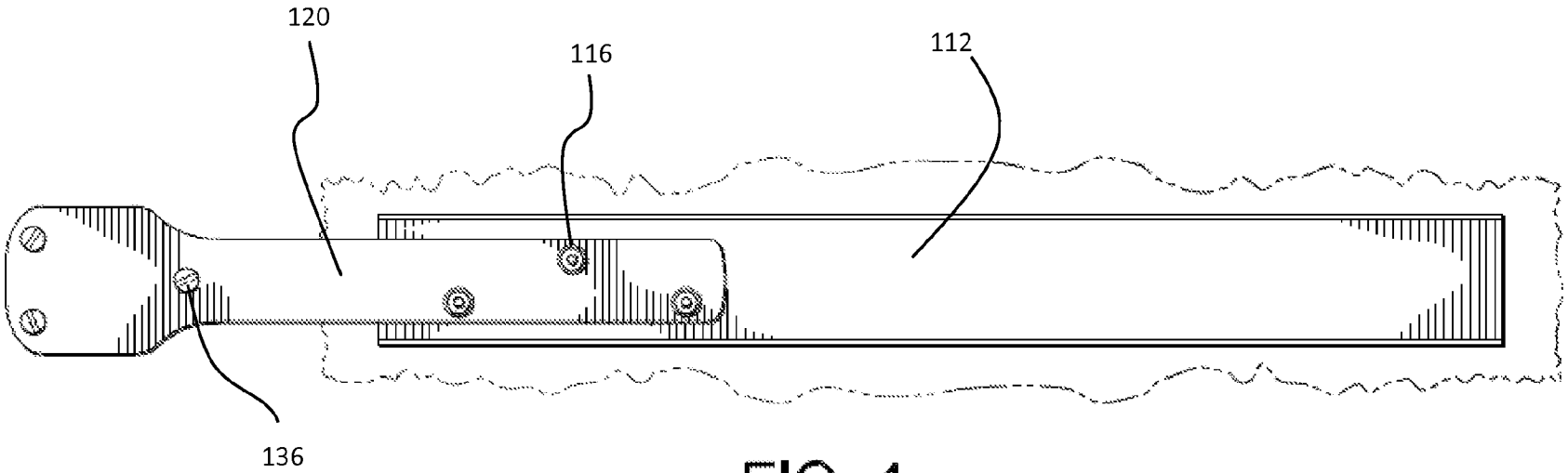
FIG. 4 is a top plan view of a broom assembly.
Figure 5:
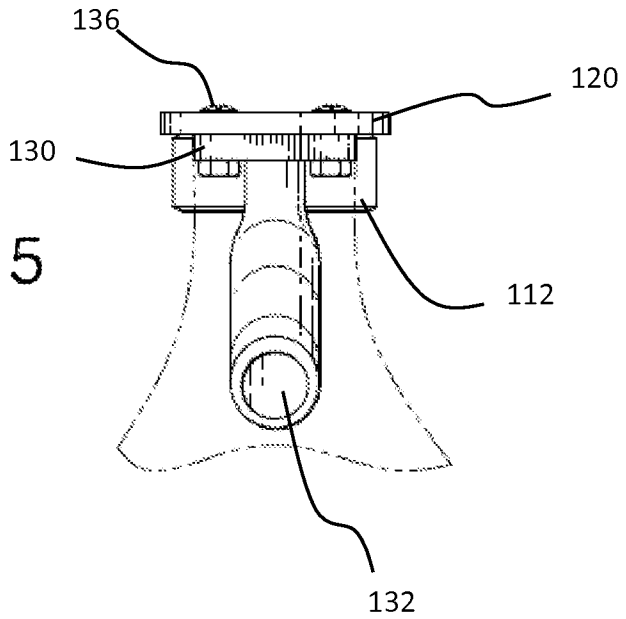
FIG. 5 is an end view of a broom assembly.

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

FIGS. 1-5 show an exemplary embodiment of a broom assembly 100. An exemplary embodiment of a broom assembly 100 may comprise a brush head 110, a mounting plate 120, a mounting bracket 130, and an elongated handle 140. Brush head 110 may include an elongated back plate 112 and a plurality of bristles 114. Bristles 114 may include hair, vegetable fiber, or synthetic material, such as nylon, carbon fiber, polyester, polyethylene, or PVC, though this list should not be read as limiting. Any other bristle material as would be reasonably understood by a person having ordinary skill in the art could be used. Bristles 114 may also include combinations of such materials. A mounting plate 120 may be removably attached to elongated back plate 112, so as to extend over a longitudinal end of brush head 110. Mounting plate 120 may optionally be attached to the elongated back plate 112 by at least one bolt and nut assembly 116, however this should not be understood as limiting. Any means of coupling reasonably anticipated by a person having ordinary skill in the art may be used, such as, but not limited to, straps, clips, adhesives, nails, or welding. A mounting bracket 130 may be removably attached to mounting plate 120 by at least one bolt and nut assembly 116, however this too should not be understood as limiting. Any means of coupling reasonably anticipated by a person having ordinary skill in the art may be used, such as, but not limited to, straps, clips, adhesives, nails, or welding. In some exemplary embodiments, mounting plate 120 may be integrally formed with back plate 112 or mounting plate 120 may be integrally formed with mounting bracket 130. In yet other exemplary embodiments, mounting bracket 130, mounting plate 120, and back plate 112 may all be integrally formed.

Back plate 112, mounting plate 120, mounting bracket 130, and handle 140 may include plastic, wood, rubber, fiberglass, carbon fiber, metal, or any other material reasonably understood by a person having ordinary skill in the art. Back plate 112, mounting plate 120, mounting bracket 130, and handle 140 may include all the same material or the different members may be made of different materials. In some exemplary embodiments, back plate 112 may include wood, mounting plate 120 may include metal, mounting bracket 120 may include metal, and handle 140 may include fiberglass. In other exemplary embodiments, back plate 112 may include plastic, mounting plate 120 may include metal, mounting bracket 120 may include plastic, and handle 140 may include carbon fiber. Yet other embodiments may include any combination of materials reasonably understood by a person having ordinary skill in the art.

Brush head 110 may be various sizes intended for general or specific uses. For example, brush head 110 may be sized to work with specific RV slideout sizes. In some exemplary embodiments, brush head 110 may be approximately 24 inches long. In other exemplary embodiments, brush head 110 may be approximately 36 inches long. Alternatively, the brush head may be approximately 18 to approximately 48 inches long. Bristles 114 disposed from brush head 110 may also be sized appropriately for use with slideouts generally or for use with specific slideouts. In some exemplary embodiments, bristles 114 may be approximately 3 inches in length. Alternatively, bristles 114 may be approximately 2 inches to approximately 8 inches long. The above provided dimensions are exemplary and should not be read as limiting. Broom assembly 100 may be any dimensions reasonably understood by a person of ordinary skill in the art.

Mounting bracket 130 may include at least one handle receiving cavity and may be disposed from the same face of mounting plate 120 as brush head 110. In some exemplary embodiments, mounting bracket 130 may have a first handle receiving cavity 132 disposed at an angle from mounting plate 120 and a second handle receiving cavity 134 disposed perpendicular to mounting plate 120. Handle receiving cavity 132 may be positioned so handle 140 extends at an angle away from brush head 112. In some exemplary embodiments, handle receiving cavity 132 may form an angle with mounting plate 120 of approximately 30 degrees to approximately 80 degrees. Handle receiving cavity 132 may angle in a direction extending past an end of elongated mounting plate 120 distal brush head 110. Mounting bracket 130 may have at least one pin receiving hole for securing a handle 140. Handle 140 may be inserted into a receiving cavity in mounting bracket 130 and may be secured by a pin 142. Pin 142 may be a wire lock pin. In other exemplary embodiments, pin 142 may be a ball bearing pin, push button pin, threaded pin, clevis pin, or any other securing pin as reasonably would be understood by a person of ordinary skill in the art, that enables handle 140 to be secured in a receiving cavity. Alternatively, any other manner of securing handle 140 in a receiving cavity, as would reasonably be understood by a person of ordinary skill in the art, may be used.

In some exemplary embodiments, handle 140 may include an elongated pole. In other exemplary embodiments, handle 140 may include a telescoping pole apparatus. For Example, handle 140 may include two elongated pole members, one elongated pole member capable of sliding in the other, and a tightening piece 144 to affix the two elongated pole members in a desirable orientation, as shown in FIG. 1. Handle 140 may be sized appropriately for general use, or for specific uses. For example, in the RV slideout cleaning application, handle 140 may be sized to reach a specific height. In one exemplary embodiment, handle 140 may telescope from 5 feet to 10 feet. Alternatively handle 140 may be approximately 3 feet to approximately 8 feet long in a retracted position and approximately 6 feet to approximately 16 feet in an extended position. In yet other embodiments, handle 140 may have a fixed length of approximately 3 feet to approximately 16 feet. These lengths should not be considered limiting, as handle 140 may be any length reasonably understood by a person having ordinary skill in the art.

An exemplary embodiment of a broom assembly may be operated as follows. A user may select a desired handle receiving cavity and attach the handle therein. The user may then extend the broom assembly over an intended surface and engage the bristles to clean the surface. In some instances, the user may brush with a side to side sweeping motion. In others, the user may hold the brush firmly and walk along the path of the desired surface, causing the brush to clean the surface as it moves in line with the user. The broom assembly may be used in any other manner reasonably understood by a person of ordinary skill in the art.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A broom assembly comprising:

a broom head which comprises an elongated back plate having opposite top and bottom surfaces and a plurality of bristles extending from the bottom surface thereof;

an elongated mounting plate which is attached to the top surface of the back plate of the broom head such that the mounting plate is substantially parallel to the back plate and also has a portion thereof extending beyond a longitudinal end of the back plate;

a handle receiving bracket attached to the mounting plate on the same side thereof as the back plate of the broom head such that the bristles and the receiving bracket are on the same side of the mounting plate, the bracket comprising at least two receiving cavities therein; and an elongated handle for insertion into a respective one of the receiving cavities in the handle receiving bracket.

2. A broom assembly in accordance with claim 1, the handle further comprising a telescopic member.

3. A broom assembly in accordance with claim 2, wherein the telescopic handle is made of fiberglass.

4. A broom assembly in accordance with claim 2, wherein the telescopic handle extends between five feet and ten feet.

5. A broom assembly in accordance with claim 1, the handle being coupled to the handle receiving bracket by a wire-lock pin.

6. A broom assembly in accordance with claim 1, the handle being coupled to the handle receiving bracket by a ball-lock pin.

7. A broom assembly in accordance with claim 1, the broom head being aligned so the bristles may be inverted.

8. A broom assembly in accordance with claim 1, the mounting plate being coupled to the back plate by bolts and nuts.

9. A broom assembly in accordance with claim 1, the plurality of bristles projecting at least three inches from the back plate.

10. A broom assembly in accordance with claim 1, wherein one of the at least two receiving cavities is disposed at an angle in relation to the mounting plate.

11. A broom assembly in accordance with claim 1, wherein one of the at least two receiving cavities is disposed substantially perpendicularly to the mounting plate.

12. A broom assembly in accordance with claim 1, wherein the mounting plate is comprised of aluminum.

13. A broom assembly in accordance with claim 1, wherein the back plate is comprised of wood.

14. A broom assembly in accordance with claim 1, wherein the back plate is comprised of plastic.

* * * * *